US006378986B2

(12) United States Patent
Van De Kruys

(10) Patent No.: US 6,378,986 B2
(45) Date of Patent: Apr. 30, 2002

(54) MODULAR INK JET PRINT HEAD

(75) Inventor: Franciscus W. J. G. Van De Kruys, Deurne (NL)

(73) Assignee: Stork Digital Imaging B.V. (NL)

( * ) Notice: Subject to any disclaimer, the term of this patent is extended or adjusted under 35 U.S.C. 154(b) by 0 days.

(21) Appl. No.: 09/777,059

(22) Filed: Feb. 5, 2001

Related U.S. Application Data

(63) Continuation of application No. PCT/NL99/00499, filed on Aug. 5, 1999.

(30) Foreign Application Priority Data

Aug. 5, 1998 (NL) ..... 1009806

(51) Int. Cl.[7] ..... B41J 2/145; B41J 2/02
(52) U.S. Cl. ..... 347/49; 347/73
(58) Field of Search ..... 347/49, 73, 50, 347/44

(56) References Cited

U.S. PATENT DOCUMENTS 3,604,980 A 9/1971 Robertson
4,277,790 A 7/1981 Heibein et al.
4,350,448 A * 9/1982 Hanagata et al. ..... 347/49
4,369,450 A * 1/1983 Iwagami et al. ..... 347/49
4,617,574 A * 10/1986 Millet et al. ..... 347/49
4,628,332 A * 12/1986 Matsumoto et al. ..... 347/49
4,809,015 A 2/1989 Bowling et al.
4,811,035 A * 3/1989 Huliba et al. ..... 347/73
4,942,408 A * 7/1990 Braun ..... 347/49
5,988,804 A * 11/1999 Kotaki et al. ..... 347/49

FOREIGN PATENT DOCUMENTS

JP 57075867 5/1982

OTHER PUBLICATIONS

Research Disclosure No 40555, XP000772381, Jan. 1998.
IBM Technical Disclosure Bulletin, vol. 22, No. 10, Mar. 1980, XP002099073.

* cited by examiner

*Primary Examiner*—Judy Nguyen
(74) *Attorney, Agent, or Firm*—Ryan A. Schneider; Todd Deveau; Troutman Sanders LLP

(57) ABSTRACT

A print head for an ink jet printer includes a number of ink nozzles for producing ink jets, charging device for charging the ink jets, and also further components assembling the print head. The ink nozzles and the charging device are accommodated in an ink jet module which can easily be removed from the further components. Furthermore, the ink jet module is composed of an ink jet unit and a charging unit, which preferably can also be easily disassembled. As a result of this modular construction of the print head, it is ensured that in the event of faults it is possible to replace only part of the print head, instead of the entire print head.

10 Claims, 5 Drawing Sheets

MODULAR INK JET PRINT HEAD

CROSS-REFERENCE TO RELATED APPLICATIONS AND CLAIM OF PRIORITY

This is a continuation application of PCT/NL99/00499 filed on Aug. 5, 1999, which PCT application claims priority on NL application number 1009806, filed Aug. 5, 1998.

FIELD OF THE INVENTION

The invention relates to a print head for an ink jet printer, comprising a number of ink nozzles for producing ink jets, charging means for charging the ink jets, and also further components assembling the print head. Such a print head is known in practice.

BACKGROUND OF THE INVENTION

In order to produce quality printing with an ink jet printer, it is necessary for the print head to function properly. Even a minor fault in proper functioning, such as one of the ink spray nozzles becoming fully or partially blocked, can lead to an unacceptable printing result. For that reason, ink jet printers are generally designed in such a way that the print head can be replaced relatively easily. However, a print head is a relatively expensive component and, apart from ink nozzles and charging means (charging electrodes), can comprise further components assembling the print head such as deflecting electrodes, intercepting element and the like, which can be fixed in or on the housing. This leads to wastage and an unnecessarily large stream of waste material. Even if replaced print heads are returned to the manufacturer for recycling of the components which are still usable, this requires additional effort, which increases costs.

The object of the invention is to eliminate the disadvantages of the prior art and to provide a print head for an ink jet printer which does not have to be replaced in full if one of the components is functioning poorly.

SUMMARY OF THE INVENTION

To this end, a print head of the type mentioned in the preamble according to the invention is characterized in that the ink nozzles and the charging means are accommodated in an ink jet module which can be detached from the further components assembling the print head.

The invention is based on the insight that a print head composed of easily detachable modules can also be easily disassembled by the end user, so that poorly functioning parts (modules) of the print head can be replaced on the spot. As assembling of the charging means onto the nozzles is relatively difficult, combining of these two parts into one ink jet module, which is easy to exchange, results in a reduced risk of errors, if this exchange is carried out by an unexperienced and/or incompetent person. Furthermore the invention is based on the insight that the ink nozzles and charging means are more sensitive to faults than the other components of the print head, such as deflecting electrodes and intercepting element, and accordingly have to be replaced more frequently. Thereby a considerable cost saving is achieved.

The invention further provides an ink jet unit for use in an ink jet printer provided with a print head according to the invention.

BRIEF DESCRIPTION OF THE DRAWINGS

The invention will be explained in greater detail below with reference to the drawing.

DESCRIPTION OF THE PREFERRED EMBODIMENTS

Figure 1:
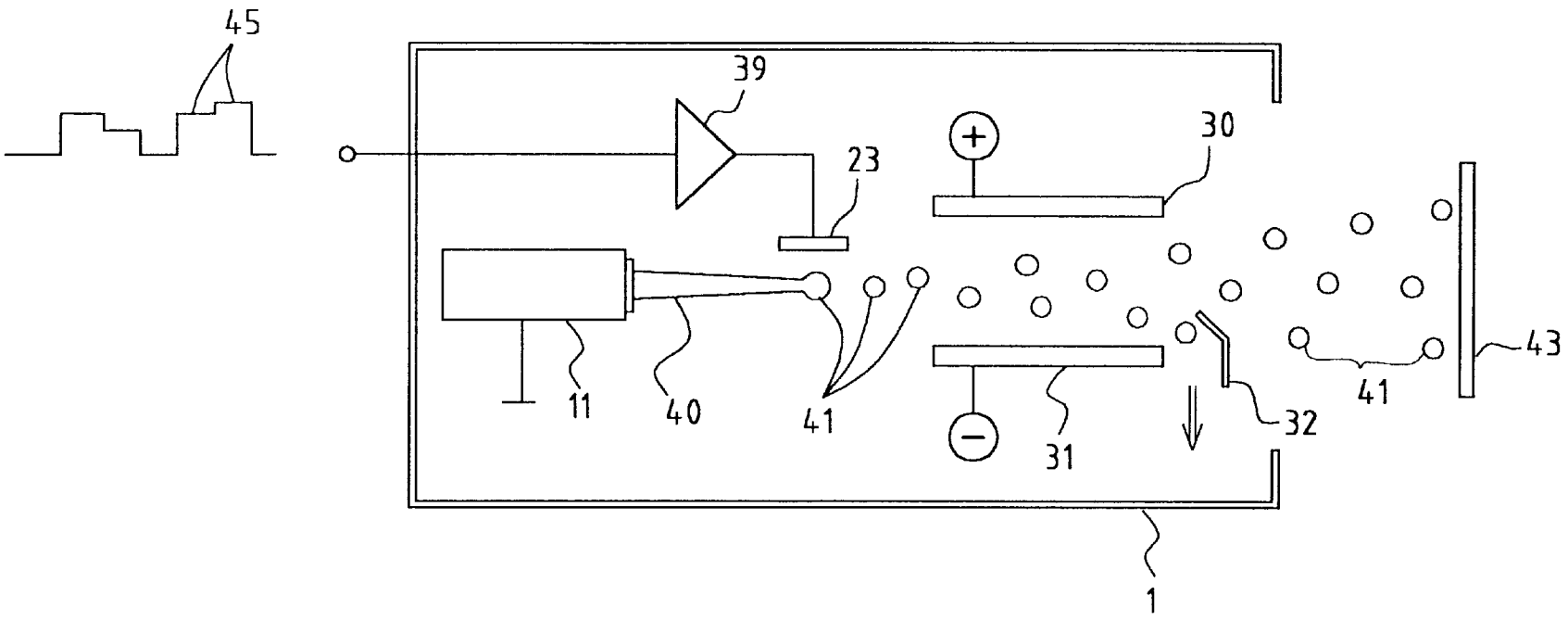
FIG. 1 shows diagrammatically a part of an ink jet printer in which the invention can be used.

The print head according to the invention is preferably designed in such a way that the further components assembling the print head define together a recess for detachably accommodating the ink jet module therein. By providing a recess in which the ink jet module can be detachably accommodated, simple fitting and removal of said ink jet module can be made possible.

The print head according to the invention is further advantageously designed in such a way that the further components assembling the print head comprise together a supporting part and a fixing part for accommodating the ink jet module in a recess formed between them, which recess in the assembled state is at least partially shut off by the supporting part. Forming the recess between two parts means that said recess can be formed simply, and thus at low cost. Furthermore, in this way, by detaching the supporting part and the fixing part, an additional method of removing the ink jet module from the further components is provided.

The print head according to the invention is advantageously designed in such a way that at least one further recess is provided in the supporting part and/or the fixing part for the accommodation of a spring element therein, in such a way that in the assembled state the spring element presses against the ink jet module. By providing a spring element which in the assembled state presses against the ink jet module, correct positioning of the ink jet module in the recess is ensured. Furthermore, secure locking of the ink jet module in the recess is achieved by the (relatively light) spring pressure. The position of the spring element is established by providing a further recess, preferably in the abovementioned recess for accommodating the ink jet module.

The print head according to the invention is preferably designed in such a way that the ink jet module comprises an ink jet unit containing the ink nozzles and a charging unit which is detachable therefrom and contains the charging means. In this case the ink jet unit and the charging unit are advantageously detachably connected to each other by means of clamping pins. A further simplification of the repair possibilities and prevention of wastage of components and repair time are achieved by also making the ink jet module of a modular design.

According to a further preferred embodiment of the print head according to the invention the ink jet module and the further components assembling the print head are provided with reference faces for alignment with respect to each other. In this way a univocal assembly is achieved, so that the different components are arranged always in the proper position without the need for further alignment and/or adjustment.

The invention further provides an ink jet unit for use in an ink jet printer provided with a print head according to the invention.

The invention will be explained in greater detail below with reference to the drawing.

FIG. 1 shows diagrammatically a part of an ink jet printer in which the invention can be used.

Figure 2:
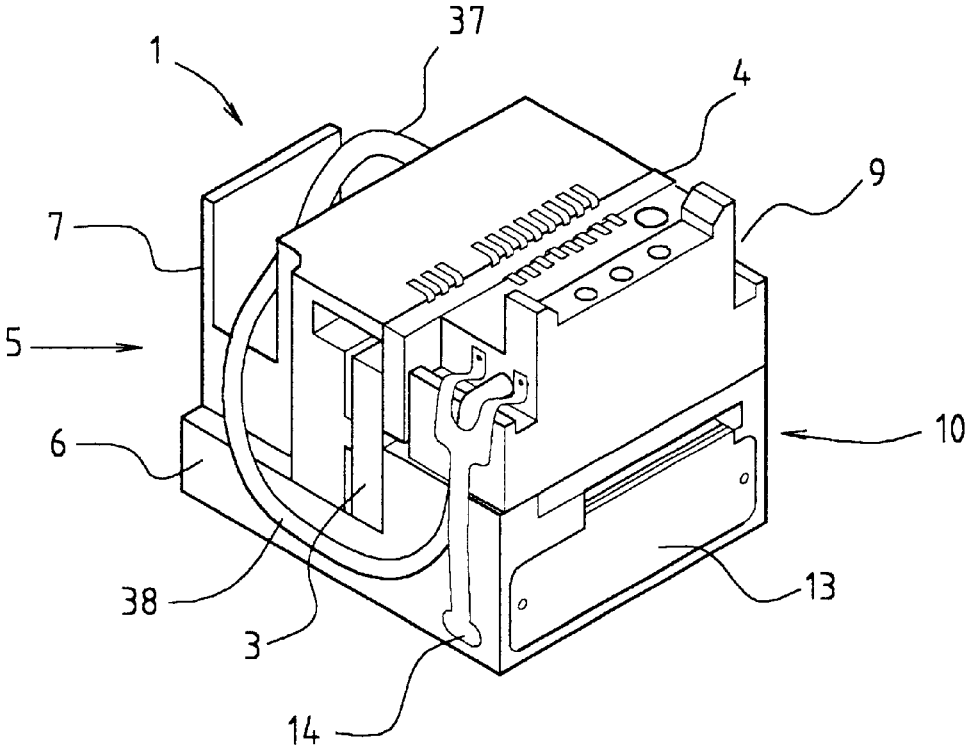
FIG. 2 shows in perspective a print head provided with a charging unit according to the invention.

FIG. 2 shows in perspective a print head provided with a charging unit according to the invention.

Figure 3:
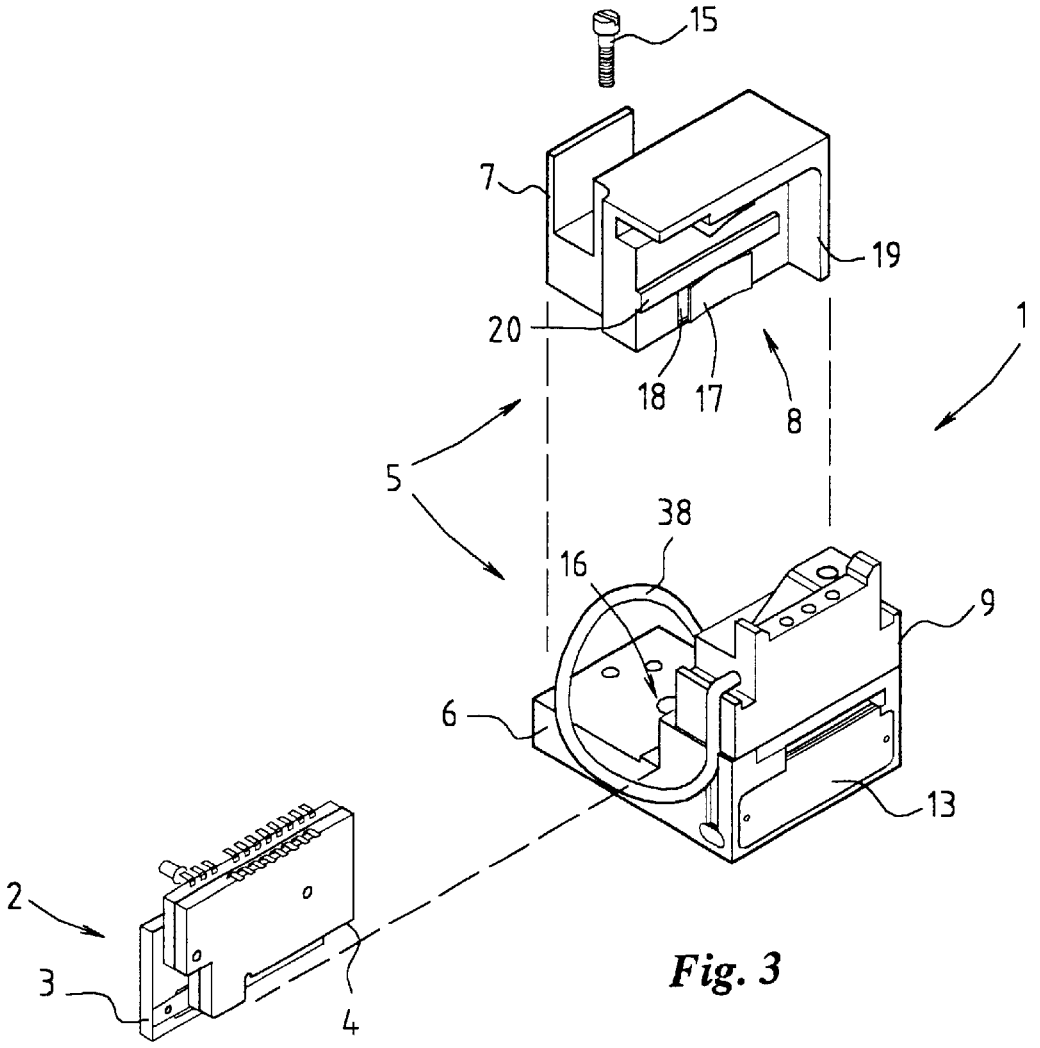
FIG. 3 shows the print head of FIG. 2 with disassembled parts.

FIG. 3 shows the print head of FIG. 2 with disassembled parts.

Figure 4:
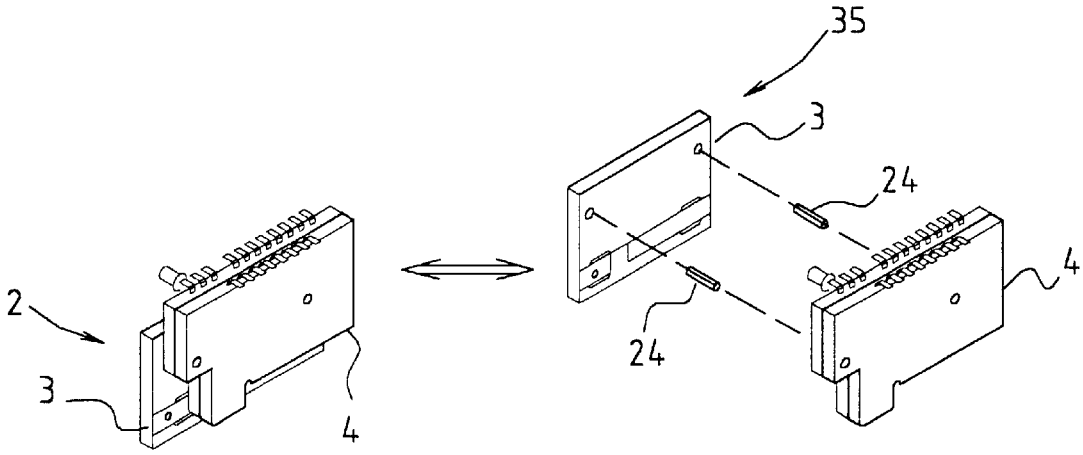
FIG. 4 shows in perspective an ink jet module according to the invention with disassembled parts.

FIG. 4 shows in perspective an ink jet module according to the invention with disassembled parts.

Figure 5:
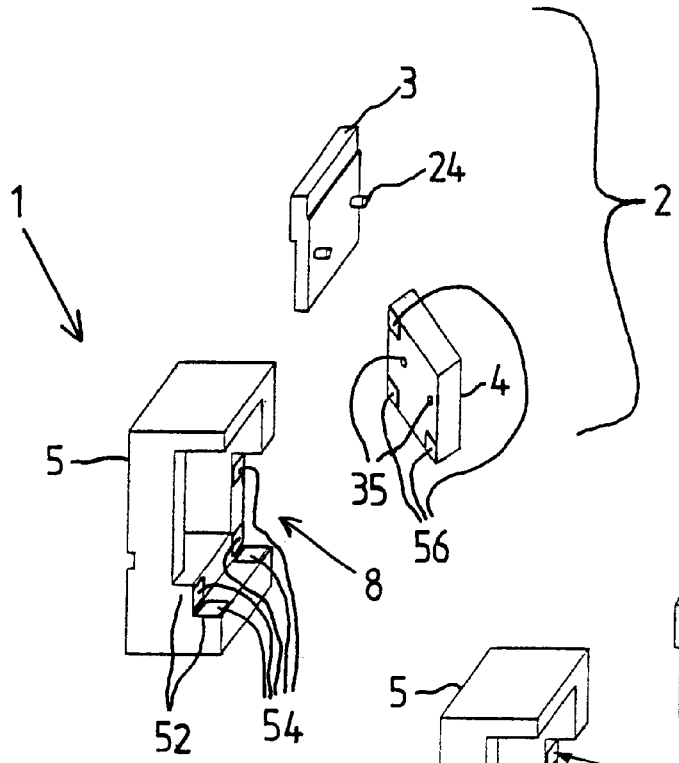
FIGS. 5–7 show a further embodiment of a print head according to the invention.
Figure 6:
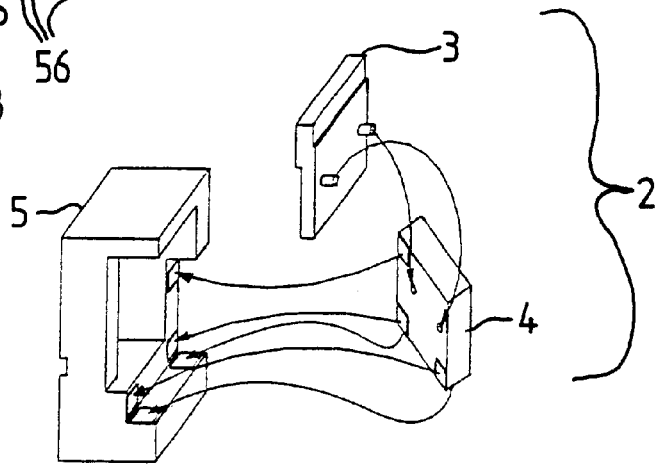
Figure 7:
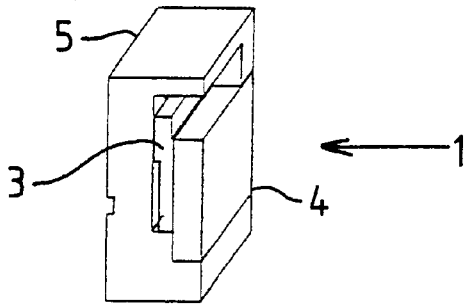

FIGS. 5–7 show a further embodiment of a print head according to the invention.

Figure 8:
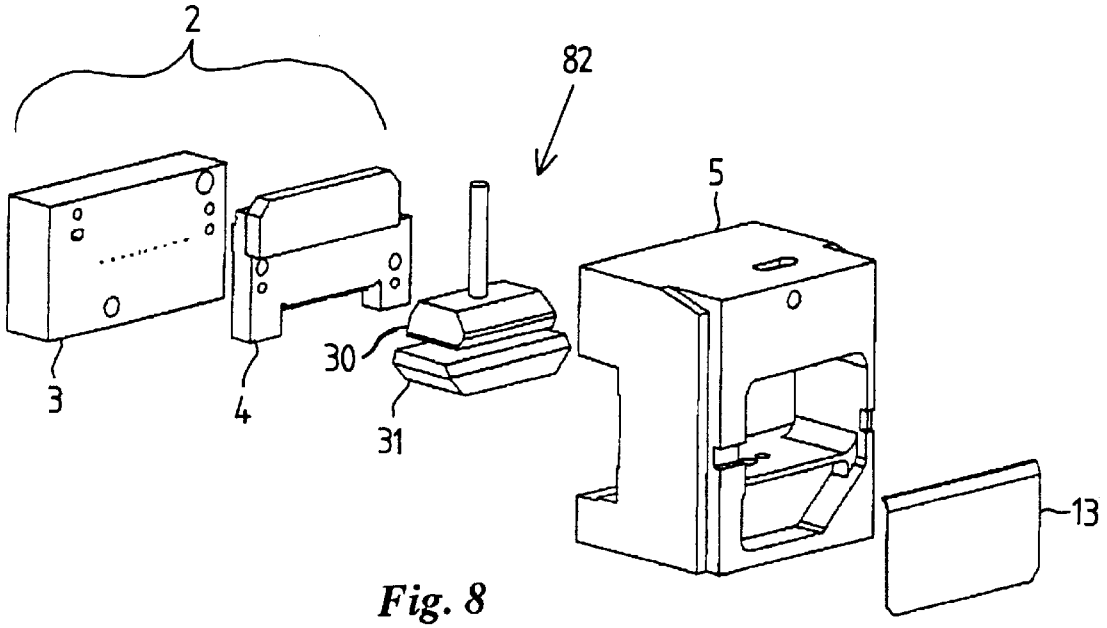
FIG. 8 shows still a further embodiment of a print head according to the invention.

FIG. 8 shows still a further embodiment of a print head according to the invention.

The print head 1 of an ink jet printer shown only diagrammatically in FIG. 1 comprises an ink nozzle 11, which produces an ink jet 40 which is directed at the substrate 43. At the level of the charging electrode 23, the ink jet 40 breaks up into individual ink droplets 41. The rhythm of the break-up, and therefore the number of ink droplets 41 produced per second, can be influenced by providing a vibrating element or actuator (not shown) on the ink nozzle 11. Charging pulses 45 are fed to the charging electrode 23 by way of an amplifier 39. As a result of this, a potential difference occurs between the charging electrode 23 and the ink jet 40, which is earthed by way of the ink nozzle 11. The ink droplets 41 forming in each case will be electrically charged as a result, under the influence of the charging pulses. By presenting the charging pulses 45 to the amplifier 39 in the rhythm in which the ink droplets 41 are formed at the end of the ink jet 40, it is ensured that each ink droplet 41 can be given an individual charge.

A direct voltage is supplied to the deflecting electrodes 30 and 31, as a result of which an electric field prevails between these electrodes. Under the influence of the electric field, the ink droplets 41 are deflected to a greater or lesser extent, depending on their charge. In the case illustrated, charging pulses with four different voltage levels are applied, V0, V1, V2 and V3 respectively. Under the influence of a charging pulse with voltage V0, which voltage can be equal to 0 V, the ink droplets 41 are deflected to the intercepting element 32. These intercepted ink droplets do not reach the substrate, but are discharged and are possibly reused. Charging pulses with a voltage V1, V2 or V3 cause the ink droplets 41 to move to three different positions on the substrate 43, as shown diagrammatically in FIG. 1. In this way, three different pixels can be formed essentially simultaneously. Through the movement of the print head 1 relative to the substrate 43, three picture lines can be printed essentially simultaneously in this way.

Of course, it is possible to generate charging pulses with, for example, only two different voltage levels (V0 and V1), as a result of which the ink droplets are either conveyed to a (fixed) position on the substrate or are intercepted. Three or more than four (five, eight, . . . ) different voltage levels can also be applied.

In practice, each print head 1 will contain several ink jet devices 11. An ink jet printer can also contain several print heads 1.

The print head 1 shown in perspective in FIG. 2 comprises a housing 5, consisting of a supporting part 6 and a fixing part 7, which is fitted on the supporting part 6. A top module 9 is likewise fixed on the supporting part 6. An ink jet unit 3 and a charging unit 4, together forming a removable ink jet module 2, are fitted between the top module 9 and the fixing part 7. The ink jet unit 3 contains a number of ink jet devices (11 in FIG. 1), while a number of charging electrodes (23 in FIG. 1), are accommodated in the charging unit 4. The top module 9 contains the top deflecting electrode (30 in FIG. 1). The intercepting element 13 (32 in FIG. 1) is fitted below the top module 9. A discharge hose 38 serves to discharge ink intercepted by the intercepting element 13. Between the top module 9 and the intercepting element 13 there is an aperture 10, through which the (deflected) ink droplets leave the print head 1. A hose 37 serves to discharge excess ink droplets from the charging unit 4 and can be connected to a discharge pump (not shown).

FIG. 3 shows the print head of FIG. 2 with disassembled parts. The supporting part 6 and the fixing part 7 of the housing 5 in the assembled state are fixed upon each other by means of a screw 15. Said screw 15 projects into a threaded aperture 16 in the supporting part 6. This design permits simple removal of the fixing part 7 from the supporting part 6.

A recess 8 is provided in the fixing part 7, into which recess the ink jet module 2 is inserted when the print head is in the assembled state. As shown in FIG. 3, the ink jet module 2 can be slid laterally into the recess 8 of the fixing part 7. A spring element 17 is accommodated in the recess 8 in such a way that in the assembled state said spring element presses against the ink jet module 2 and holds the latter in place. A further recess 18 is provided for the accommodation of the spring element 17 in the fixing part 7. The recess 8 is shut off on two sides by an edge 19 and on a third side (in the assembled state) by the supporting part 6. A rib 20, provided in the recess 8, facilitates the sliding in of the ink jet unit 2.

FIG. 4 shows the detachable design of the ink jet module 2. The ink jet unit 3 and the charging unit 4, which together form the ink jet module 2, are detachably connected to each other by means of clamping pins 24. For that purpose, apertures 35 are provided both in the ink jet unit 3 and in the charging unit 4, into which apertures the clamping pins 24 can be inserted in a tight fit, but in such a way that they are detachable.

The modular design of the print head according to the invention makes it very simple to replace defective components. If the print head 1 is not functioning properly, the ink jet module 2 can be slid in its entirety out of the further components. The ink jet module 2 can then either be replaced in its entirety or disassembled. In the latter case either the ink jet unit 3 or the charging unit 4 can be replaced, after which the ink jet module 2 can be simply reassembled by clamping the units 3 and 4 together. Thereafter the ink jet module 2 can be slid back again.

It is also possible for the top module 9 to be designed so that it is easily detachable. In the embodiment shown the top module 9 is detachably connected to the supporting part 6 by means of clips 14.

In the embodiment shown the ink jet module 2 is held in place in the housing 5 by means of, inter alia, a spring element 17. Another type of fastening may be used if desired, for example an easily detachable locking or snap connection.

FIGS. 5–7 show diagrammatically a second embodiment of a print head 1 according to the invention. In FIG. 5 this print head 1 is shown in disassembled state. As also shown in FIG. 4, the ink jet unit 3 and the charging unit 4 which define together the ink jet module 2, are detachably connected to each other by means of pins 24 of the ink jet unit 3, which fit into openings 35 of the charging unit 4. A one-piece housing 5 is provided with a recess 8, into which the ink jet module 2 can be positioned. In order to allow for a univocal assembly, as indicated in FIG. 6 by arrows, the walls 52 of the housing 5 delimiting the recess 8 are provided with five reference faces 54 in the embodiment shown, which faces correspond to like reference faces 56 (only three visible) of the charging unit 4. The assembled print head is shown in FIG. 7.

FIG. 8 shows the detachable configuration of a further embodiment of a print head 1 according to the invention, comprising an ink jet module 2 consisting of an ink jet unit 82 and charging unit 4, deflecting electrodes 30 and 31 which are constructed as a detachable module and a housing 5 having an intercepting element 13 adhered thereto.

It will therefore be clear to the person skilled in the art that the invention is not restricted to the exemplary embodiments shown, and that many modifications and additions are possible without departing from the essence of the invention.

What is claimed is:

1. A print head for an ink jet printer, comprising a number of ink nozzles for producing ink jets, a charging means for charging said ink jets, and also further components assembling said print head, wherein said ink nozzles and said charging means are accommodated in an ink jet module, wherein said further components define together a recess for detachably accommodating said ink jet module therein.

2. The print head according to claim 1, wherein said further components assembling said print head comprise a supporting part and a fixing part for accommodating said ink jet module in said recess formed between them, said recess in an assembled state is at least partially shut off by said supporting part.

3. The print head according to claim 2, wherein at least one further recess is provided for the accommodation therein of a spring element, in such a way that in said assembled state said spring element presses against said ink jet module.

4. The print head according to claim 2, wherein a rib is provided which in said assembled state faces said ink jet module and extends in the longitudinal direction of said ink jet module.

5. The print head according to claim 2, wherein in said assembled state said supporting part and said fixing part are connected to each other by a single fixing element.

6. The print head according to claim 5, wherein said fixing element is formed by a screw, and wherein a threaded aperture is provided in said supporting part.

7. The print head according to claim 1, wherein said ink jet module comprises an ink jet unit containing said ink nozzles and a charging unit which is detachable therefrom and contains said charging means.

8. The print head according to claim 7, wherein said ink jet unit and said charging unit are detachably connected to each other by means of clamping pins.

9. The print head according to claim 1, wherein said further components assembling said print head and said ink jet module are provided with reference faces for alignment of said ink jet module with respect to said further components assembling said print head.

10. An ink jet printer, provided with a print head according to claim 1.

* * * * *